US008344608B2

(12) United States Patent
Matsuda et al.

(10) Patent No.: US 8,344,608 B2
(45) Date of Patent: Jan. 1, 2013

(54) HOT CATHODE FLUORESCENT LAMP AND ELECTRODE FOR FLUORESCENT LAMP

(75) Inventors: Junji Matsuda, Tokyo (JP); Mitsunari Yoshida, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 299 days.

(21) Appl. No.: 12/729,527

(22) Filed: Mar. 23, 2010

(65) Prior Publication Data

US 2010/0244660 A1 Sep. 30, 2010

(30) Foreign Application Priority Data

Mar. 24, 2009 (JP) ..... 2009-071542

(51) Int. Cl.
*H01J 1/62* (2006.01)
*H01J 63/04* (2006.01)

(52) U.S. Cl. ..... 313/491; 313/344; 313/345

(58) Field of Classification Search ..... 313/628, 313/491, 344, 271, 345; 445/51, 52
See application file for complete search history.

(56) References Cited

U.S. PATENT DOCUMENTS 2,479,192 A * 8/1949 Zabel ..... 313/343
2,479,193 A * 8/1949 Zabel ..... 313/343
4,032,809 A * 6/1977 Corth ..... 313/344
4,355,259 A * 10/1982 Weiss ..... 313/337
4,443,738 A * 4/1984 Roy ..... 313/491
5,729,081 A * 3/1998 Hoffmann et al. ..... 313/344
6,465,939 B1 * 10/2002 Ward et al. ..... 313/271
2007/0228913 A1 10/2007 Horikoshi et al.

FOREIGN PATENT DOCUMENTS

JP 6-295704 A 10/1994
JP 2004-303620 A 10/2004
JP 2005-235749 A 9/2005

* cited by examiner

*Primary Examiner* — Mariceli Santiago
*Assistant Examiner* — Glenn Zimmerman
(74) *Attorney, Agent, or Firm* — Kenealy Vaidya LLP

(57) ABSTRACT

A long-life hot cathode fluorescent lamp can include a pair of parallel lead wires that can be arranged at each end of a tube. A coiled filament can be connected at its opposite end portions to the lead wires. The coiled filament can have two long pitched regions in which a coil pitch is longer than regions outside of the long pitched regions. Emitter can be located in a region defined between the two long pitched regions. Shape characteristics and intensive current flow obtained by the presence of the long pitched regions can form the origins of discharge near the boundaries between long and short pitched regions. Accordingly, stable discharge can be achieved with the origins of discharge located at ends of the emitter. As a result, the hot cathode fluorescent lamp is allowed to have a long life and stable light emission characteristics.

24 Claims, 3 Drawing Sheets

Fig. 3
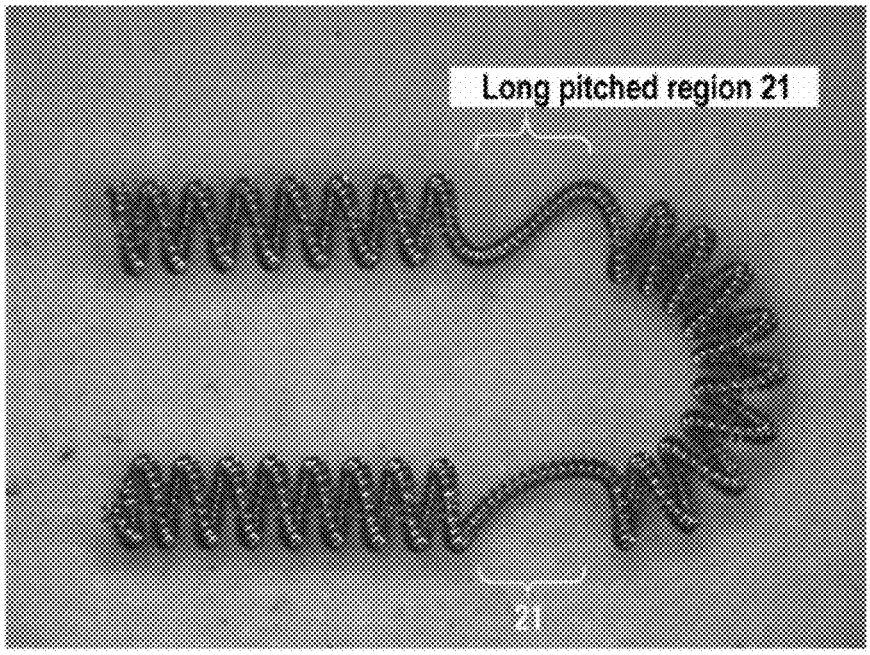
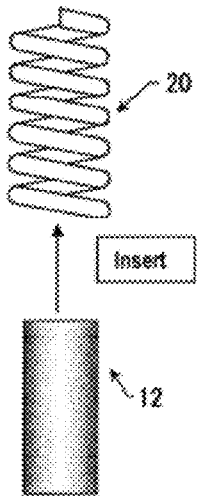
Fig. 4A
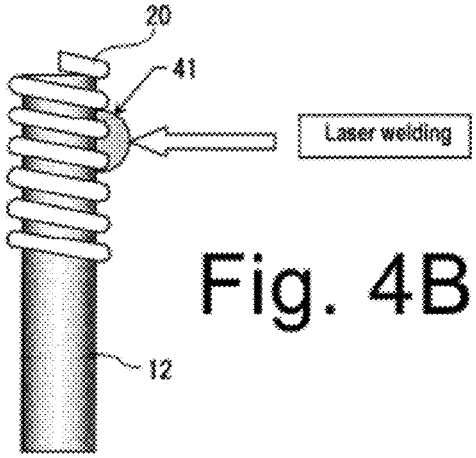
Fig. 4B

HOT CATHODE FLUORESCENT LAMP AND ELECTRODE FOR FLUORESCENT LAMP

This application claims the priority benefit under 35 U.S.C. §119 of Japanese Patent Application No. 2009-071542 filed on Mar. 24, 2009, which is hereby incorporated in its entirety by reference.

BACKGROUND

1. Technical Field

The presently disclosed subject matter relates to a long-life hot cathode fluorescent lamp with stable light emission characteristics.

2. Related Art

Cold cathode fluorescent lamps have widely been used as light sources of backlight units for use in large-sized liquid crystal televisions, for example. In light of the recent importance associated with energy savings, it has been suggested that hot cathode fluorescent lamps, superior in light emission efficiency to cold cathode fluorescent lamps, be used as light sources of backlight units.

Light sources of backlight units for liquid crystal display devices have been required to be long life, and small in diameter. These two requirements should be satisfied when hot cathode fluorescent lamps are to be used as light sources of backlight units for liquid crystal display devices.

The lifetime of a hot cathode fluorescent lamp is shortened with degradation of its fluorescent substance, a reduction of filling gas, and other characteristics. The most important determining factor of lifetime is the amount of electron emission material (emitter) that is applied to a coil filament (hereinafter simply referred to as a coil) serving as an electrode. So, a desirable structure of the electrode of a hot cathode fluorescent lamp has been one in which the amount of emitter can be applied can be increased. However, there is a competing interest in that an electrode should also be small in size to allow a small diameter for a fluorescent lamp. Thus, the electrode should be of a structure that allows a greater amount of emitter to be applied in smaller space.

A coil can generally serve as an electrode after being attached to a pair of lead wires and then fixed therebetween. Suppose a case where a coil is incorporated in a hot cathode fluorescent lamp of a large diameter (what is called a fluorescent tube) generally applied for lighting purposes, such as the case disclosed in figure three of Japanese Patent Application Laid-Open No. Hei 6-295704. In this case, the hot cathode fluorescent lamp can have a coil in which the axis of the coil extends in a direction perpendicular to a direction in which the axis of the lead wires extends, and opposite ends of the coil are supported by the tips of the lead wires. Generally, the coil and the lead wires can be fixed by bending and swaging the tips of the lead wires so that the coil can be held in place.

Japanese Patent Application Laid-Open No. 2004-303620 discloses an example of a hot cathode fluorescent lamp of a small diameter. This hot cathode fluorescent lamp employs a structure where the axis of a coil with only one turn extends in a direction perpendicular to a direction in which the axis of a lead wire extends.

Here, it is assumed that a fluorescent lamp with a glass tube of a small diameter employs a structure as disclosed in Japanese Patent Application Laid-Open Nos. Hei 6-295704 and 2004-303620 in which the respective axes of a coil and a lead wire extend in directions perpendicular to each other. In this case, the opposite end portions of the coil may project outward of the lead wire (in the direction of a tube diameter), so that the coil may disadvantageously contact the inner wall of the glass tube.

An electrode structure responsive to reduction of the diameter of a fluorescent lamp and which provides improved means for fixing of a coil and lead wires has been suggested in figure one of Japanese Patent Application Laid-Open No. Hei 6-295704, for example. In this electrode structure, the coil is bent into a U shape, and is then fixed to the lead wires so that the axis of the coil at its opposite end portions extends in the same direction as the axis of the lead wires. Then, the coil is fixed by welding to the lead wires.

Japanese Patent Application Laid-Open No. 2005-235749 discloses a coil formed into a helical shape. Accordingly, in this case, the axis of a filament of the coil at its end portion extends in the same direction as the axis of a lead wire. Thus, the end portion of the coil can be fixed to the lead wire with their respective axes extending in the same direction. Also in this case, the coil and the lead wire are fixed by welding. While not disclosing a concrete way of welding, there is disclosed process steps including welding with the core of the coil remaining as it is, and subsequent dissolving of the core.

When employed in a fluorescent lamp with a glass tube of a small diameter, the above-described lamp structure where the axis of a coil extends in a direction perpendicular to a direction in which the axis of a lead wire extends may cause problems as described below.

In more detail, in the structure of a common hot cathode fluorescent lamp disclosed in Japanese Patent Application Laid-Open No. Hei 6-295704, an end portion of a coil can project outward of a lead wire, so that the end portion of the coil may contact the inner wall of a glass tube (a coil touch is generated). Generation of the coil touch can transfer heat of the coil to the inner wall of the glass tube while the lamp lights up. This melts the glass tube by heating, thereby causing possible leakage, deformation, etc. In a process for activating a material of the emitter applied to the coil by using a coil current to make the material serve as emitter, generation of the coil touch also transfers heat of the coil to the inner wall of the glass tube contacting the coil. In this case, the heat is diffused throughout the glass tube, and then escapes. Accordingly, the emitter cannot be heated and activated sufficiently, thereby shortening the lifetime of the emitter.

Furthermore, using a coil with only one turn as disclosed in Japanese Patent Application Laid-Open No. 2004-303620 results in reduction of coil length. This reduces the amount of emitter that can be applied to the coil, so that attempts to provide a long-life fluorescent lamp are frustrated.

Considered next is a structure where a coil is bent into a U shape and is then fixed to a lead wire as disclosed in Japanese Patent Application Laid-Open No. Hei 6-295704. In this device, when emitter is to be applied in sufficient abundance, a boundary between a region to which emitter is applied and a region to which no emitter is applied is defined in a linear portion near the lead wire. This makes it impossible to define the origin of discharge, resulting in a possibly unstable stage of discharge. Also, in this device, an end portion of the coil and the lead wire are closely aligned along some length, and partially welded by a metal bump at one point. Accordingly, a portion of the coil from its welded point to its end remains unfixed and is a redundant portion that does not contribute to discharge. This redundant portion may disadvantageously be bent to project toward the wall of a glass tube, so that a coil touch may be generated.

Furthermore, the coil is arranged along the lead wire, and is welded to the lead wire at a contact point. This may cause the coil to vibrate easily. Furthermore, the coil, if fixed in a stressed condition to the lead wire, may be deformed while a lamp lights up. Vibration or deformation of the coil that occur while the lamp lights up may make it impossible to achieve desirable characteristics, or may cause a failure that hinders the lamp from lighting up or shortens the lifetime of the lamp.

Also, the coil may be thermally shocked depending on a welding condition, by which tungsten being the principal component of the coil may become brittle. This may cause a failure leading to the wearing out or breakdown of the coil while the lamp in its finished state lights up.

Regarding the helical coil disclosed in Japanese Patent Application Laid-Open No. 2005-235749, a straight filament at an end portion of the coil and the linear lead wire are connected to each other. In order to do so, a connection reinforcing member called a heat tab is used. In this case, the size of the connection reinforcing member may hinder diameter reduction of a glass tube.

SUMMARY

The presently disclosed subject matter was devised in view of these and other characteristics, features, problems and in association with the conventional art. According to an aspect of the presently disclosed subject matter, there is provided a long-life hot cathode fluorescent lamp with stable light emission characteristics.

According to another aspect of the disclosed subject matter, a hot cathode fluorescent lamp can include: a tube configured to be sealed at its opposite ends; a pair of parallel lead wires arranged at each end of the tube; a coiled filament having opposite end portions which are connected to the parallel lead wires, respectively; and emitter held on the coiled filament, wherein the coiled filament has two long pitched regions in which a coil pitch is longer than that in their surrounding regions, and a region defined between the two long pitched regions contains the emitter. Shape characteristics and intensive current flow obtained by the presence of the long pitched regions can form the origins of discharge near the boundaries between long and short pitched regions. Accordingly, stable discharge can be achieved with the origins of discharge placed at ends of the emitter. As a result, the hot cathode fluorescent lamp is allowed to have a long life and stable light emission characteristics.

As an example, the coiled filament can be configured such that the tip portions of the pair of the lead wires are inserted a predetermined length into voids of the coil filament at its opposite end portions, respectively, so that the coiled filament and the lead wires are fixed together. The coiled filament can also be configured such that part of the coiled filament that does not hold the lead wires therein is bent. This can prevent a coil touch caused by the contact of the coiled filament with the tube wall, and allows the lead wires to be well spaced from each other. As a result, a greater amount of emitter can be applied.

The coiled filament may be a multiple winding coil, for example. In this case, antivibration performance can be improved in the long pitched regions. The voids of the coil filament at its opposite end portions may be formed by the multiple winding coil.

The two long pitched regions each can extend a predetermined length from the tip of each of the lead wires so that the emitter can be applied to a region of a greater length. The long pitched regions can have a length in a range of not less than 2.5 times and not more than 7 times the length of the region defined between the two long pitched regions.

The emitter can cover the region in its entirety defined between the two long pitched regions of the coiled filament. This is because it allows boundaries between the long and short pitched regions in which a current flows intensively to coincide with the ends of the emitter, and increases the amount of emitter.

Another aspect of the presently disclosed subject matter is the ability to provide an electrode for a fluorescent lamp. More specifically, the electrode can be used in a fluorescent lamp and can include: a glass member of a fixed shape; a pair of parallel lead wires held by the glass member; and a coiled filament having opposite end portions which are connected to the parallel lead wires, respectively. The coiled filament has two long pitched regions in which a coil pitch is longer than that in their surrounding regions.

As an example, the coiled filament can be configured such that the tip portions of the pair of lead wires are inserted a predetermined length into voids of the coil filament at its opposite end portions, so that the coiled filament and the lead wires are fixed together. The coiled filament can also be configured such that part of the coiled filament that does not hold the lead wires therein is bent.

The coiled filament may be a multiple winding coil, for example. The voids of the coil filament at its opposite end portions may be formed by the multiple winding coil.

BRIEF DESCRIPTION OF THE DRAWINGS

These and other characteristics, features, and advantages of the presently disclosed subject matter will become clear from the following description with reference to the accompanying drawings, wherein:

FIG. 3 is a photograph of a coil filament of the hot cathode fluorescent lamp shown in FIG. 1;

FIG. 4A is a diagram illustrating a process of inserting a tip portion of a lead wire into a coil filament through its end portion during an exemplary manufacturing process for the hot cathode fluorescent lamp of the exemplary embodiment;

FIG. 4B is a diagram illustrating a process of applying slurry containing a high-melting point metal to the coil filament in which the lead wire is placed, and of performing laser welding thereafter during an exemplary manufacturing process for the hot cathode fluorescent lamp of the exemplary embodiment.

DETAILED DESCRIPTION OF EXEMPLARY EMBODIMENTS

An exemplary embodiment of a hot cathode fluorescent lamp made in accordance with principles of the presently disclosed subject matter will be described below.

Figure 1:
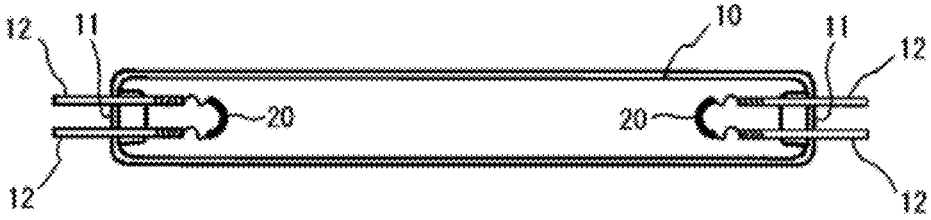
FIG. 1 is a cross sectional view of a hot cathode fluorescent lamp according to an exemplary embodiment made in accordance with principles of the presently disclosed subject matter.

FIG. 1 shows the overall structure of an exemplary hot cathode fluorescent lamp. As shown in FIG. 1, the hot cathode fluorescent lamp can include: a glass tube 10, sealing parts 11 for sealing the glass tube 10 at its opposite ends; a pair of lead wires 12 that penetrate the sealing parts 11 from the inside toward the outside of the glass tube 10; and coil filaments 20 attached to the respective tip portions of the lead wires 12 inside the glass tube 10. The sealed glass tube 10 can contain mercury and a discharge gas. The coil filaments 20 can be coated with emitter in their fixed regions as described later.

Figure 2:
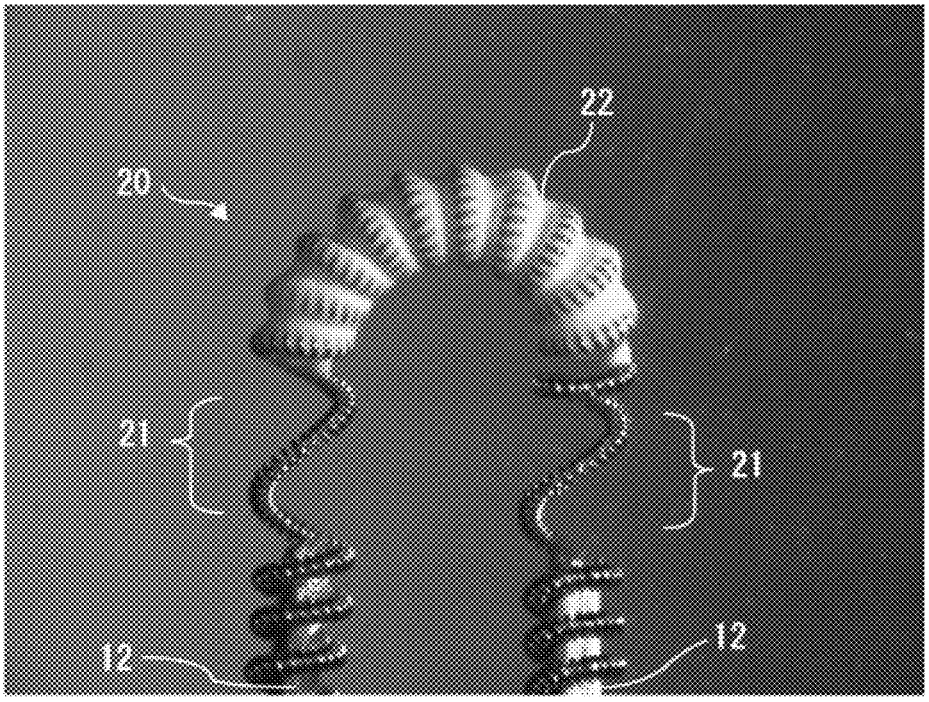
FIG. 2 is a photograph of an electrode part of the hot cathode fluorescent lamp shown in FIG. 1.

FIG. 2 is an enlarged photograph of the coil filament 20 fixed to the tip portions of the lead wires 12. FIG. 3 is an enlarged photograph of the overall structure of the coil filament 20 to which emitter is yet to be applied.

As shown in FIGS. 2 and 3, the coil filament 20 of the present exemplary embodiment can be a multiple winding of tungsten filament coil. In more detail, the filament coil 20 can be a double winding coil made by winding a tungsten filament into a coil (primary winding), and by further winding the coil (secondary winding). Then, a resultant coil is bent into a U shape to form the coil filament 20. The diameter of the secondary winding of the filament coil can be configured such that it allows the lead wires 12 to be inserted thereinto.

By way of example, the coil filament 20 can be a double winding coil having a filament diameter of about 4 MG (36.5 μm), a primary coil diameter of about 0.153 mm, and a secondary coil diameter of about 0.63 mm.

It should be noted that in the present description the axial direction of the coil may mean the extending direction of the secondary winding (in the vertical direction of the filament coil 20 shown in FIGS. 4A & B).

The coil filament 20 bent into a U shape can have two long pitched regions 21 in predetermined positions where the secondary winding is long pitched. As shown in FIG. 2, the long pitched regions 21 may be separated away by a predetermined length from the tips of the lead wires 12. The pitch of the secondary winding may be constant in a region outside the long pitched regions 21. Likewise, the pitch of the long pitched regions 21 may be constant. Alternatively, the pitch of each region can vary, with the various pitches in the long pitched regions 21 being longer than some or all of the pitches in the region outside the long pitched regions 21. The coil pitch can be calculated as the length of the coil divided by the number of coils in the given length.

A short pitched region defined between the two long pitched regions 21 can be coated with emitter 22.

Figure 5:
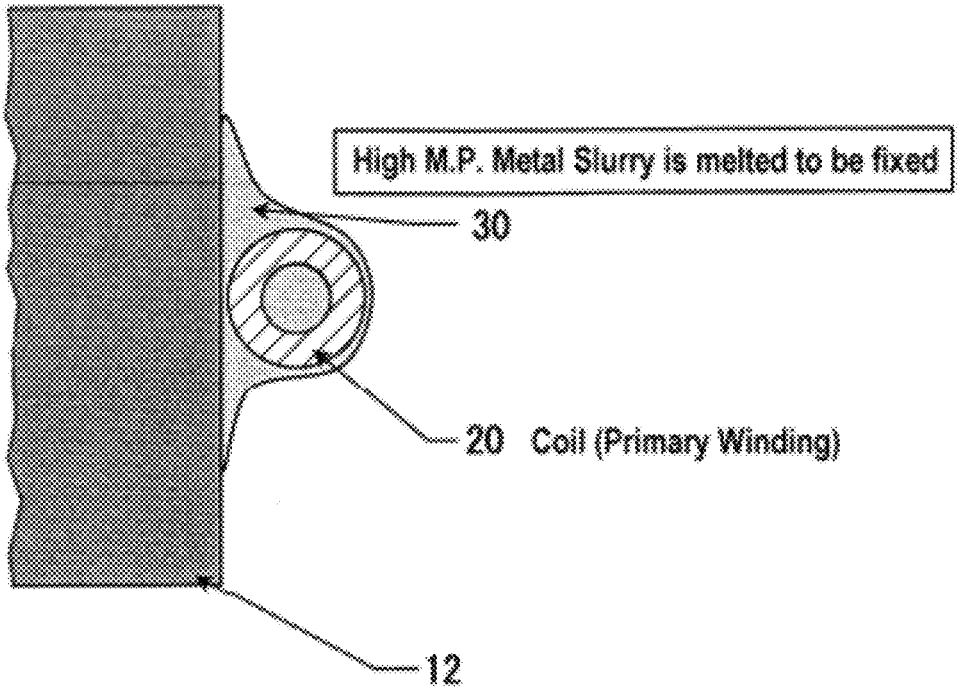
FIG. 5 is a sectional view showing how the coil filament and the lead wire are welded by a meltage of the high-melting point metal after the process shown in FIG. 4B is performed.

As shown in FIGS. 4A and 4B, the lead wire 12 can be inserted into voids inside the secondary winding of the coil filament 20 so that the lead wire 12 will be placed in the short pitched region between an end of the long pitched region 21 and an end of the coil filament 20. This short pitched region can be subjected to laser welding by using, for example, a slurry containing powder of a high-melting point metal such as molybdenum. Accordingly, after laser welding, the coil filament 20 and the lead wire 12 can be firmly fixed together by a meltage of the high-melting point metal as shown in FIG. 5. The coil filament 20 and the lead wire 12 can also be electrically connected. This process of fixation allows the axis of the coil filament 20 to extend in the same direction as the axis of the lead wire 12, while allowing the coil filament 20 to be firmly fixed to the lead wire 12. As a result, the end portion of the coil filament 20 is prevented from touching the glass tube 10.

Provided that the coil pitch of the secondary winding in the short pitched region has a ratio of 1:1 or 100%, the coil pitch in the long pitched regions 21 may have a ratio in a range of not less than 2.5:1 or 250% and not more than 7:1 or 700%, and more preferably, in a region of not less than 2.5:1 or 250% and not more than 4:1 or 400%. A still more preferable coil pitch may be about 3:1 or 300%. The actual length of the secondary winding in the long pitched regions 21 may beneficially be about 0.5 to 1.5 mm. This is because, the long pitched regions 21, when they are too short, transfer heat from the emitter 22 to the lead wires 12, so that a temperature decrease of the coil filament 20 and emitter 22 may occur. When the long pitched regions 21 are too short in length, it may be difficult to apply the emitter 22 only to a region between the long pitched regions 21 at the time of manufacture. Conversely, the long pitched regions 21, when they are too long, degrade anti-vibration performance.

The pitch can differ largely between the long pitched regions 21 and the short pitched region. For example, the coil filament 20 can have one-half a turn of wire in the long pitched regions 21. This is because when there is an insufficient difference in pitch between the long pitched regions 21 and the short pitched region it can be difficult to define the origin of discharge of the emitter 22. The coil filament 20 is not necessarily required to have one-half a turn of wire in the long pitched regions 21, but may have a greater number of turns of wire such as one turn, or one and a half turns, etc.

As discussed, the long pitched regions 21 can be formed by stretching out part of the secondary winding of the double winding coil to reduce the number of turns of wire to a fixed number. This means that, in the long pitched regions 21, the filament coil 20 is not a single wire of tungsten, but is in the form of a structure formed by winding a single coil (primary winding) very loosely. Thus, stress applied as a result of vibrational shock to the fulcrum of vibration can be diffused throughout the long pitched regions 21. Further, the primary winding in the long pitched regions 21 can serve to disperse vibration. Accordingly, the coil filament 20 can provide higher antivibration performance than typical coil filament structures. The coil filament 20 can also prevent a failure, such as a breakdown of a filament or drop-off of emitter material that may be generated during vibration.

An exemplary embodiment of a process of forming a hot cathode fluorescent lamp will be described next.

First, a tungsten filament can be wound into a coil (primary winding) with a certain pitch, and the coil can further be wound (secondary winding) with another certain pitch. A resultant double winding coil can be bent into a U shape. Then, the secondary winding can be stretched out in predetermined positions to a predetermined length to form the long pitched regions 21. At this time, the double winding coil can be placed into a die prepared in advance in such a way that the entire shape of the double winding coil conforms to the die, so that the second winding is stretched out. This allows the long pitched regions 21 of the predetermined length to be formed precisely in the predetermined positions. Then, the coil filament 20 with a structure shown in FIG. 3 is formed.

Next, a stem can be formed by using a known process. The stem may include a pair of lead wires 12, and a sealing glass member of a certain shape made of glass beads or the like through which the lead wires 12 penetrate. Next, as shown in FIG. 4A, the tip portion of each of the lead wires 12 can be inserted a predetermined length into the short pitched region at an end portion of the coil filament 20. Then, a slurry 41 containing a high-melting point metal such as molybdenum or tungsten, etc., can be applied along the periphery of the coil filament 20. A laser beam can then be applied to the slurry 41 (it may not be necessary to apply the laser beam to the coil filament 20). This can melt the high-melting point metal in the slurry 41 to create a meltage 30, so that the coil filament 20 can be fixedly attached to the lead wire 12 by the meltage 30 as shown in FIG. 5. Use of the slurry 41 allows the coil filament 20 to be welded to the lead wire 12 without changing the shape of the coil filament 20, while preventing embrittlement by welding of the coil filament 20.

The slurry 41 can be made by diffusing powder of a high-melting point metal such as molybdenum or tungsten into an organic solvent or the like, and by processing the mixture into a form of slurry or paste. The powder of the high-melting point metal can have a particle diameter of about 5 to 20 μm, and can beneficially be about 10 μm.

Next, as shown in FIG. 2, the emitter 22 (for example, in the form of molten salt) can be applied to the short pitched region of the coil filament 20 between the long pitched regions 21 that are fixed to the tip portions of the lead wires 12. In this process, the existence of the long pitched regions 21 allows a solution containing the material of the emitter 22 to be easily applied only to the short pitched region between the long pitched regions 21. Thus, the solution is prevented from being poured out and reaching the lead wires 12, so that the solution does not adhere to the lead wires 12. This easily defines a region to be coated with the emitter 22 and allows the emitter 22 to be applied in a stable amount, so that variations in lifetime of hot cathode fluorescent lamps are reduced.

The coil filament 20 can be fixed to the lead wires 12, and the stem (e.g., the pair of lead wires 12, and a sealing glass member of a certain shape made of glass beads or the like through which the lead wires 12 penetrate) when coated with the emitter 22 (hereinafter referred to as a mount) can be inserted into a glass tube 10 of a certain diameter through one end thereof. Then, the sealing glass member made of glass beads or the like and the glass tube 10 can be melted to seal the glass tube 10.

Next, another mount can be inserted into the glass tube 10 through the other end thereof. Then, an exhaust pipe can be connected to the glass tube 10, if necessary, and a mercury source can be inserted into the glass tube 10 or the exhaust pipe. Air inside the tube 10 can be thereafter sucked out to create a vacuum. Then, with the glass tube 10 in this condition, a current can be supplied to the coil filaments 20, and the emitter 22 can be activated by heating. At this time, the lead wires 12 can be located in the end portions of the coil filaments 20, so that the end portions of the coil filaments 20 do not contact the wall of the glass tube 10. This prevents heat transfer to the wall of the glass tube 10, and allows the emitter 22 to be activated by sufficient heating. Further, the region coated with the emitter 22 and each of the lead wires 12 can be spaced apart by a length of the long pitched region 21. Thus, heat of the region coated with the emitter 22 resists being transferred to the lead wires 12, so that the emitter 22 can be activated by sufficient heating.

After activation of the emitter 22, a predetermined discharge gas can be filled inside the space, and the glass tube 10 or the exhaust pipe can be sealed. Thereafter mercury can be released from the mercury source by using a known process. Then, the glass member made of glass beads or the like of the mount and the glass tube 10 can be joined together to seal the glass tube 10.

Next, in order to stabilize the characteristics of the lamp in an initial lighting period, a current is supplied to the coil filaments 20 for a predetermined period of time so that the emitter 22 will age. By following the processes described so far, the hot cathode fluorescent lamp of the present exemplary embodiment can be completed.

A fixed current can be applied to the coil filaments 20 in order to turn the hot cathode fluorescent lamp on. As shown in the photograph of FIG. 2, the coil does not have a uniform pitch, but has the long pitched regions 21 between the part coated with the emitter 22 and the parts welded to the lead wires 12. This means the long pitched regions 21 are defined at opposite end portions of the part at which the coil filament 20 generates heat while the lamp is in operation. Accordingly, the ends of the heated part of the coil filament 20 can coincide with boundary points of emitter application. These ends can also coincide with boundaries between the long and short pitches, so that a lamp current flows intensively therein. Thus, bright spots (glowing part of the coil filament 20, namely the origins of discharge) can be formed in the boundaries between the long and short pitches (boundary points of emitter application) in which a lamp current flows intensively, thereby creating thermal electrons. The presence of the difference in pitch allows the origins of discharge to be placed in fixed positions (boundaries between the long pitched regions 21 and the short pitched region). This realizes discharge in a stable condition and achieves stable light emission characteristics.

The origins of discharge placed in fixed positions (boundaries between the long and short pitches) makes it possible to shorten time of processing (aging) required for stabilization of the characteristics of the lamp in an initial lighting period.

In the embodiment of FIG. 1, the coil filaments 20 can each have an axis (e.g., a central axis extending through a center portion about which the secondary winding is wound) at its end portions extending in the same direction as the axis of the lead wires 12 and which are welded to the lead wires 12. This configuration can prevent a coil touch to be caused by the contact of the coil filament 20 with the glass tube 10. Thus, the pair of lead wires 12 are allowed to be well spaced from each other, and a filament is allowed to have a sufficient length. A greater amount of emitter can be applied accordingly, so that it is possible to manufacture a long-life fluorescent lamp of a small diameter.

Furthermore, the absence of fear of a coil touch allows the emitter 22 to be heated sufficiently, while avoiding a problem of leakage to occur by a crack in the glass tube 10 due to a coil touch.

The presence of the long pitched regions 21 in the coil filaments 20 can prevent the solution that contains the material of the emitter 22 from adhering to the lead wires 12 during the process of applying the emitter 22. This facilitates definition of a region to be coated with the emitter 22, allowing the emitter 22 to be applied in a stable amount. Thus, variation in lifetime of the hot cathode fluorescent lamps can be prevented.

Further, the presence of the long pitched regions 21 in the coil filaments 20 formed by stretching out the double winding coil advantageously causes stress applied as a result of vibrational shock to a fulcrum point of vibration to be diffused throughout the long pitched regions 21. Also, the long pitched regions 21 can be formed by stretching out the secondary winding of the double winding coil. This means that, in each of the long pitched regions 21, the filament coil 20 is not a single wire, so the primary winding in the long pitched regions 21 can also serve to disperse vibration. Thus, the coil filaments 20 can provide higher antivibration performance than a coil filament of generally known structures, thereby preventing a failure, such as a breakdown of a filament or drop-off of emitter material, to be generated during vibration.

Laser welding using a slurry containing a high-melting point metal such as molybdenum or tungsten can be used for welding the coil filaments 20 and the lead wires 12. Thus, a failure of the coil filaments 20 such as deformation, embrittlement or breakdown by welding is unlikely, resulting in low probability of occurrence of problems, such as unexpectedly short lifetime or unstable discharge.

It will be apparent to those skilled in the art that various modifications and variations can be made in the presently disclosed subject matter without departing from the spirit or scope of the presently disclosed subject matter. Thus, it is intended that the presently disclosed subject matter cover the modifications and variations of the presently disclosed subject matter provided they come within the scope of the appended claims and their equivalents. All related art references described above are hereby incorporated in their entirety by reference.

What is claimed is:

1. A hot cathode fluorescent lamp, comprising:

a tube including opposite ends of the tube;

a pair of substantially parallel lead wires arranged at each end of the tube;

a coiled filament having opposite end portions which are connected to the substantially parallel lead wires, respectively; and an emitter located on the coiled filament, wherein the coiled filament has two long pitched regions in which a coil pitch of the coiled filament in the two long pitched regions is greater than the coil pitch of the coiled filament located in regions outside of the two long pitched regions, a continuous region of the coiled filament located between the two long pitched regions includes the emitter, and an entirety of the coiled filament other than the continuous region between the two long pitched regions does not include the emitter.

2. The hot cathode fluorescent lamp according to claim 1, wherein:

the coiled filament has a void at each of the coiled filament opposite end portions;

a tip portion of each of the pair of the lead wires is inserted a predetermined length into a respective void at each of the coiled filament opposite end portions, so that the coiled filament and the lead wires are fixed together; and part of the coiled filament spaced from the lead wires is bent.

3. The hot cathode fluorescent lamp according to claim 1, wherein the coiled filament is a multiple winding coil.

4. The hot cathode fluorescent lamp according to claim 2, wherein the coiled filament is a multiple winding coil.

5. The hot cathode fluorescent lamp according to claim 3, wherein a void at each of the coiled filament opposite end portions is formed by the multiple winding coil with a central axis extending through the multiple winding coil.

6. The hot cathode fluorescent lamp according to claim 4, wherein the void at each of the coiled filament opposite end portions is formed by the multiple winding coil.

7. The hot cathode fluorescent lamp according to claim 1, wherein each of the two long pitched regions connects to and then extends a predetermined length from a tip of each of the lead wires, respectively.

8. The hot cathode fluorescent lamp according to claim 2, wherein each of the two long pitched regions extends a predetermined length from a tip of the tip portion of each of the lead wires.

9. The hot cathode fluorescent lamp according to claim 3, wherein each of the two long pitched regions extends a predetermined length from a tip of each of the lead wires, respectively.

10. The hot cathode fluorescent lamp according to claim 4, wherein each of the two long pitched regions extends a predetermined length from a tip of the tip portion of each of the lead wires.

11. The hot cathode fluorescent lamp according to claim 5, wherein each of the two long pitched regions extends a predetermined length from a tip of each of the lead wires, respectively.

12. The hot cathode fluorescent lamp according to claim 6, wherein each of the two long pitched regions extends a predetermined length from a tip of the tip portion of each of the lead wires, respectively.

13. The hot cathode fluorescent lamp according to claim 7, wherein each of the long pitched regions has a length in a range of not less than 2.5 times and not more than 7 times a length of a region of the coiled filament defined between the two long pitched regions.

14. The hot cathode fluorescent lamp according to claim 8, wherein each of the long pitched regions has a length in a range of not less than 2.5 times and not more than 7 times a length of a region of the coiled filament defined between the two long pitched regions.

15. The hot cathode fluorescent lamp according to claim 9, wherein each of the long pitched regions has a length in a range of not less than 2.5 times and not more than 7 times a length of a region of the coiled filament defined between the two long pitched regions.

16. The hot cathode fluorescent lamp according to claim 10, wherein each of the long pitched regions has a length in a range of not less than 2.5 times and not more than 7 times a length of a region of the coiled filament defined between the two long pitched regions.

17. The hot cathode fluorescent lamp according to claim 11, wherein each of the long pitched regions has a length in a range of not less than 2.5 times and not more than 7 times a length of a region of the coiled filament defined between the two long pitched regions.

18. The hot cathode fluorescent lamp according to claim 12, wherein each of the long pitched regions has a length in a range of not less than 2.5 times and not more than 7 times a length of a region of the coiled filament defined between the two long pitched regions.

19. The hot cathode fluorescent lamp according to claim 1, wherein the coiled filament includes an intermediate region that extends from a point in contact with an end of a first of the two long pitched regions to a point in contact with an end of a second of the two long pitched regions such that the intermediate region does not overlap with the two long pitched regions, and wherein the emitter continuously covers the intermediate region in its entirety from the point in contact with the end of the first of the two long pitched regions to the point in contact with the end of the second of the two long pitched regions.

20. An electrode for a fluorescent lamp, comprising:

a glass member of a fixed shape;

a pair of substantially parallel lead wires adjacent the glass member; and a coiled filament having opposite end portions which are connected to the substantially parallel lead wires, respectively, and an emitter located on the coiled filament, wherein the coiled filament has two long pitched regions in which a coil pitch of the coiled filament in the two long pitched regions is greater than every coil pitch of the coiled filament located in regions outside of the two long pitched regions, a continuous region of the coiled filament located between the two long pitched regions includes the emitter, and all regions of the coiled filament other than the region between the two long pitched regions does not include the emitter.

21. The electrode for a fluorescent lamp according to claim 20, wherein:

the coiled filament has a void at each of the coiled filament opposite end portions;

a tip portion of each of the pair of the lead wires is located a predetermined length into a respective void at each of the coiled filament opposite end portions, so that the coiled filament and the lead wires are fixed together; and part of the coiled filament spaced from the lead wires is bent.

22. The electrode for a fluorescent lamp according to claim 20, wherein the coiled filament is a multiple winding coil.

23. The electrode for a fluorescent lamp according to claim 21, wherein the coiled filament is a multiple winding coil.

24. The electrode for a fluorescent lamp according to claim 23, wherein the void at each of the coiled filament opposite end portions is formed by the multiple winding coil.

* * * * *